US008550963B1

(12) United States Patent
Bradford et al.

(10) Patent No.: US 8,550,963 B1
(45) Date of Patent: Oct. 8, 2013

(54) LEG EXERCISE ASSEMBLY

(75) Inventors: Ernesto Juan Bradford, Ocala, FL (US); Neal Marlin Davis, Gainesville, FL (US)

(73) Assignee: The Global DR Group LLC, Miami, FL (US)

( * ) Notice: Subject to any disclaimer, the term of this patent is extended or adjusted under 35 U.S.C. 154(b) by 289 days.

(21) Appl. No.: 12/927,121

(22) Filed: Nov. 8, 2010

(51) Int. Cl.

| | |
|---|---|
| ***A63B 23/08*** | (2006.01) |
| ***A63B 23/10*** | (2006.01) |
| ***A61H 1/00*** | (2006.01) |
| ***A61H 1/02*** | (2006.01) |
| ***A61H 5/00*** | (2006.01) |

(52) U.S. Cl.
USPC ..... 482/79; 601/29

(58) Field of Classification Search
USPC ..... 482/1–9, 51–52, 70–71, 79–80, 92, 482/133, 135–138, 142, 145, 146; 601/23, 601/27–36; 434/253, 255
See application file for complete search history.

(56) References Cited

U.S. PATENT DOCUMENTS

| | | | | |
|---|---|---|---|---|
| 2,826,192 | A | | 3/1958 | Mangas |
| 2,969,060 | A | | 1/1961 | Swanda et al. |
| 3,774,597 | A | | 11/1973 | Root |
| 3,824,994 | A | | 7/1974 | Soderberg, Sr. |
| 4,351,406 | A | * | 9/1982 | Lay ..... 180/65.1 |
| 4,862,875 | A | | 9/1989 | Heaton |
| 4,921,243 | A | * | 5/1990 | Weidmann ..... 482/80 |
| 5,044,355 | A | | 9/1991 | Reopelle |
| 5,328,443 | A | * | 7/1994 | Lee ..... 601/92 |
| 5,855,538 | A | | 1/1999 | Argabright |
| 6,582,344 | B2 | | 6/2003 | Tang |
| 6,709,368 | B1 | | 3/2004 | Chue |
| 7,179,236 | B2 | | 2/2007 | Galvez Campos |

* cited by examiner

*Primary Examiner* — Oren Ginsberg
(74) *Attorney, Agent, or Firm* — Malloy & Malloy, P.L.

(57) ABSTRACT

An assembly is structured to facilitate exercise of at least the legs of a user especially, but not exclusively, when the user is in an at least partially seated orientation. A plurality of support members are disposed and structured to movably and at least partially support a different foot of the user. Drive linkage is driven by a drive member and interconnected drive motor and is interconnected in driving relation to one or both of the support members by connector structure associated therewith. Cooperative structuring between drive member, drive linkage and connector structure results in linear, oppositely directed, reciprocal travel of the support members relative to one another, while engaging and supporting the feet of the user, upon actuation of the drive motor.

2 Claims, 8 Drawing Sheets

SEE DETAIL 11A
SEE DETAIL 12A
10
12
16
20
22
23
23'
32
34
42
53
55
57
60
61
63
63'
-57-
-60-

LEG EXERCISE ASSEMBLY

BACKGROUND OF THE INVENTION

1. Field of the Invention

The present disclosure is directed to an exercise assembly structured to facilitate movement and resulting exercise of a user's legs especially, but not exclusively, when the user is in an at least partially seated orientation. Two support members are disposed and structured to movably and at least partially support the feet of the user while continuously moving in a linear, oppositely directed, reciprocal manner. As a result, the feet and legs of the user are urged to reciprocally move with the support members resulting in the exercising of the user's legs while the user is seated.

2. Description of the Related Art

As is commonly recognized, physical exercise is fundamental for maintaining overall good health as well as facilitating the efficient functioning of the various parts of the human body, such as legs, arms, etc. However, many geographical areas of the world have been industrially developed to the extent where physical labor, more common in years past, has been significantly reduced and in many cases eliminated. As a result, a large number of individuals perform their daily tasks or functions while seated. Moreover, the fairly recent development and proliferation of computer technology, has resulted in a significant portion of today's labor force, remaining seated at a desk or other work place. As a result, many individuals receive practically no physical exercise during the work day. Such physical inactivity can, over the course of time, negatively impact an individual's health.

More specifically, the lack of physical activity may directly affect circulation and in turn result in joint and leg pains, fatigue and an overall discomfort. One obvious solution to the lack of exercise is the practice of a simple but appropriate exercise routine or procedure such as, but not limited to, walking, jogging, etc. However, consistent adherence to such exercise routines frequently involves regular exposure to the outdoors. While in many situations, outdoor activity may be considered beneficial there are times when an individual will be subjected to uncomfortable weather conditions such as heat, rain, etc.

In order to overcome such disadvantages and problems, modern day societies have turned to the commercial availability of gymnasiums and/or like exercise facilities which allow an individual to perform an exercise routine under more favorable or comfortable conditions. Obvious disadvantages associated with such commercial facilities include cost as well as logistics. Therefore, such facilities must be conveniently located and meet an individual's budgetary restrictions.

Therefore, there is a need in this area for an exercise assembly which is low in cost, reliable in operation and convenient in terms of size, configuration and overall structure. Such a proposed exercise assembly could be primarily, but not exclusively, used to provide at least a minimally required amount of exercise to the feet, legs and possibly other lower torso portions of an individual. In addition, such a proposed exercise assembly should be operative to allow its use in either a work or domestic environment by an individual while in an at least partially seated orientation.

As a result, a proposed leg exercise assembly would be structured to provide at least a minimal but adequate amount of exercise to an individual in a manner which would significantly reduce the need for the performance of more ambitious exercise procedures, on an everyday basis.

SUMMARY OF THE INVENTION

The present disclosure is directed to an assembly structured to facilitate the exercise of at least the legs and feet of a user specifically, but not exclusively, while the user is in an at least partially seated orientation. Moreover, the present leg exercise assembly is dimensioned and configured to be easily carried by a single individual between different operative locations. Accordingly, the structure of the leg exercise assembly is such as to facilitate it being placed in an operative position beneath a desk, table, etc., so as to be accessible by the feet of the individual. When the individual's feet are positioned to interact with the leg exercise assembly in the intended manner, at least the feet and legs of the user will be urged to move in a prescribed manner, thereby providing at least some amount of exercise to the individual. As will be more apparent hereinafter, the present leg exercise assembly is specifically adapted for use by individuals that spend a significant portion of their waking hours in a seated position or orientation, such as at a desk, worktable, etc.

The various embodiments of the leg exercise assembly of the present disclosure comprise a base which includes a housing or casing sufficiently structured to contain or enclose various operative components, including at least a portion of an electrically powered drive motor. The drive motor may be powered by a conventional electrical power supply typically found in a household or commercial environment. As will be further noted, the drive motor may include at least one drive shaft or other drive component drivingly connected to at least one drive member.

In addition, a support platform is movably connected to and at least partially supported on the base and includes at least two support members or "pedals". Each of the support members is dimensioned and configured to engage and at least partially support a different foot of the user. Interaction between the feet of the user and each of the support members is facilitated by the provision of an exposed surface which may be in the form of a tread or like structure. More specifically, the exposed surface or tread of each of the support members may be structured to provide at least a minimal frictional engagement with the undersurface of a corresponding foot or associated footwear of the user. In addition, the exposed surface of each support member may be structured to include at least a minimal degree of compressibility. The resulting frictional engagement will facilitate the "forced" movement or at least "urging" of the feet and legs of the user with the support members in a reciprocal, oppositely directed, path of travel, during activation of the drive motor.

At least some of the working components of the leg exercise assembly may vary, depending on which of the plurality of embodiments are utilized. However, common to each of the embodiments is the cooperative structuring of the corresponding components to establish the aforementioned linear, oppositely directed, reciprocal movement or travel of the two support members relative to one another upon activation of the drive motor. Accordingly, the feet and legs of the user will be urged to move substantially in the same motion as that of the two support members. The intended result will be exposing a normally sedentary individual to at least some amount of exercise of at least the feet and legs of that individual.

In order to accomplish the intended reciprocal travel of the two support members, one or more of the embodiments of the leg assembly includes at least one drive member connected in driven relation to the drive motor. In addition, drive linkage is interconnected in driven relation to the drive member and in driving relation to at least one or both of the aforementioned two support members. Also, a connector structure is mounted on, connected to or otherwise operatively associated with one or both of the support members so as to move therewith. Moreover, the connector structure associated with one or both of the two support members is cooperatively structured with the aforementioned drive linkage to force movement or travel of each of the support members in the linear, oppositely directed, reciprocal path relative to one another, upon activation of the drive motor.

As indicated, the versatility of the leg exercise assembly is such as to accomplish the intended movement or travel utilizing various structural modifications of the drive member, drive linkage, and/or connector structure. More specifically, at least one embodiment of the leg exercise assembly includes the drive linkage comprising at least one cam member and the connector structure associated with one or both of the support members comprising at least one cam race. As such, the at least one cam member may be connected to or mounted on the connecting linkage or alternatively may be connected to or mounted on the drive member. In cooperation therewith, the at least one cam race includes an elongated, linear configuration cooperatively disposed and dimensioned to receive and be driven by a correspondingly positioned at least one cam member.

Others of the possible plurality of embodiments of the leg exercise assembly includes a plurality of the cam members each disposed in driven interconnection with the drive member. Each of the plurality of cam members may be received within and drivingly engage different ones of a plurality of cam races. As such, each of a plurality of two cam races are mounted on or associated with different ones of the two support members. In order to facilitate smooth interaction and reduce friction between the one or more cam members and the corresponding cam races, each of the cam members may include an appropriate bearing structure. Such a bearing structure facilitates rotation of a corresponding cam member about an axis of rotation defined as a part thereof. Therefore, as each cam member moves along the length of the corresponding cam race, it may rotate about its defined axis of a rotation. As a result, an efficient driving engagement of each cam member with a corresponding cam race is facilitated and the aforementioned intended reciprocal motion or travel of each of the two support segments relative to one another is accomplished.

The versatility of the leg exercise assembly is further demonstrated by the ability to use different types of drive motors at least partially dependent on the structural and operative features of the drive linkage and/or connector structure associated with a particular embodiment of the leg exercise assembly. More specifically, the drive motor may be such as to be rotationally driven and thereby serve to force rotation of a drive member associated therewith. Alternatively, the drive motor may be structured to provide a reciprocal driving action to the associated drive linkage. In turn, the drive linkage is cooperatively structured and disposed with the corresponding connector structure of the one or more support members to provide the intended reciprocal travel of the two support members relative to one another.

As set forth above, at least one application of the leg exercise assembly is intended for use by an individual while he or she is in a seated or at least partially seated orientation. However, with minimal structural modifications, the leg exercise assembly may be operative for use with individuals in a standing or at least partially, upright orientation. Structural modifications of this type include the base and support platform being capable of movably supporting a significantly greater portion of the weight of the user, while providing for the intended reciprocal travel of the two support members. As such, all structural modifications needed to adapt one or more embodiments for use with an individual in an upright orientation are considered to be included in the intended spirit and scope of the present disclosure.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION

As represented in the accompanying figures, the present disclosure is directed to a leg exercise assembly generally indicated as 10. As described in greater detail hereinafter, the leg exercise assembly 10, as represented by the plurality of embodiments disclosed, is primarily, but not exclusively, intended to provide for exercising movement of at least the feet and legs of a user, while seated or in an at least partially seated orientation.

Figure 1:
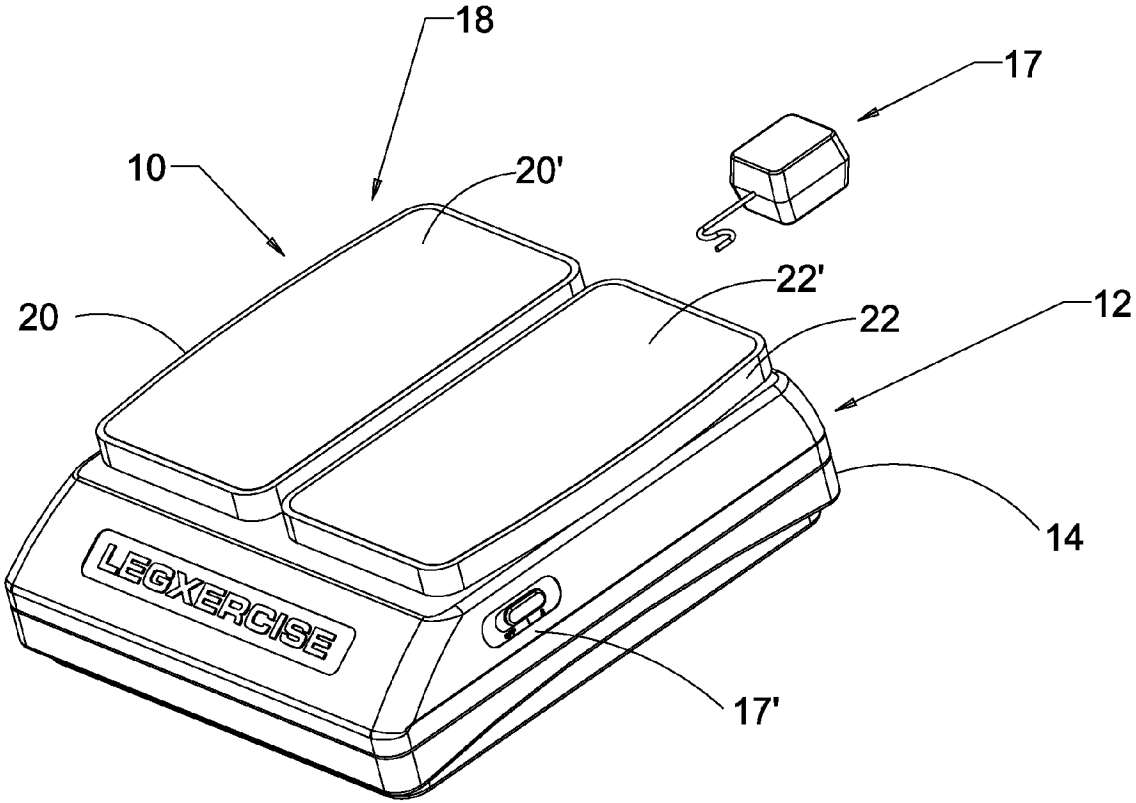
FIG. 1 is a perspective view of the exterior of one embodiment of a leg exercise assembly in accordance with the present disclosure, along with an electrical connection assembly which may be associated therewith.

The leg exercise assembly 10 as shown in FIG. 1 includes a base generally indicated as 12, and a housing or casing 14. The housing 14 includes an interior of sufficient dimension and configuration to contain at least some of the operative components associated with the operation of the leg exercise assembly 10. Also, certain structural and operative components of the leg exercise assembly 10 are electrically powered such as, but not limited to, a drive motor 16, as schematically represented in the embodiments of at least FIGS. 3, 7, 8, 11 and 12. As should be apparent, additional embodiments of the leg exercise assembly 10 may include the drive motor being at least partially disposed on the interior of the housing 14. The leg exercise assembly 10 may also be associated with appropriate electrical connectors or other electrical components, generally indicated as 17, used to electrically connect the drive motor 16 to a wall outlet or other electrical power source. Activation of the drive motor may be accomplished manually by manipulation of an activating switch 17'.

With further regard to the embodiment of FIG. 1, the leg exercise assembly 10 includes a support platform 18 comprising at least two support members 20 and 22 each interconnected in driven relation by the drive motor 16 (not shown) through cooperatively disposed and structured drive linkage and connector structure, as described in considerable detail with reference to FIGS. 2 through 12A.

Each of the support members 20 and 22, also referred to as "pedals", may include an exterior exposed surface 20' and 22' in the form of a tread or like structure disposed to engage or confront the feet or associated footwear of a user. More specifically, each of the support members or pedals 20 and 22 are dimensioned and configured to at least partially support and urge movement of a different foot of the user. As such, the structural and operative features of the tread and/or exposed surfaces 20' and 22' are such as to establish at least a minimal frictional or "gripping" engagement with the feet or footwear of the user. The feet and legs of the user are thereby urged to move with corresponding ones of the support members 20 and 22, as they are driven or forced to move in a linear, oppositely directed, reciprocal manner relative to one another, such as, in at least one embodiment, upon activation of drive motor 16.

As noted above, FIGS. 2 through 12A are illustrative of various embodiments of the leg exercise assembly 10 in accordance with the present disclosure and are presented in schematic form for purposes of clarity. As such, the structural representations of at least the base 12, support members 20 and 22 and other components may differ from that shown in FIG. 1.

Figure 2:
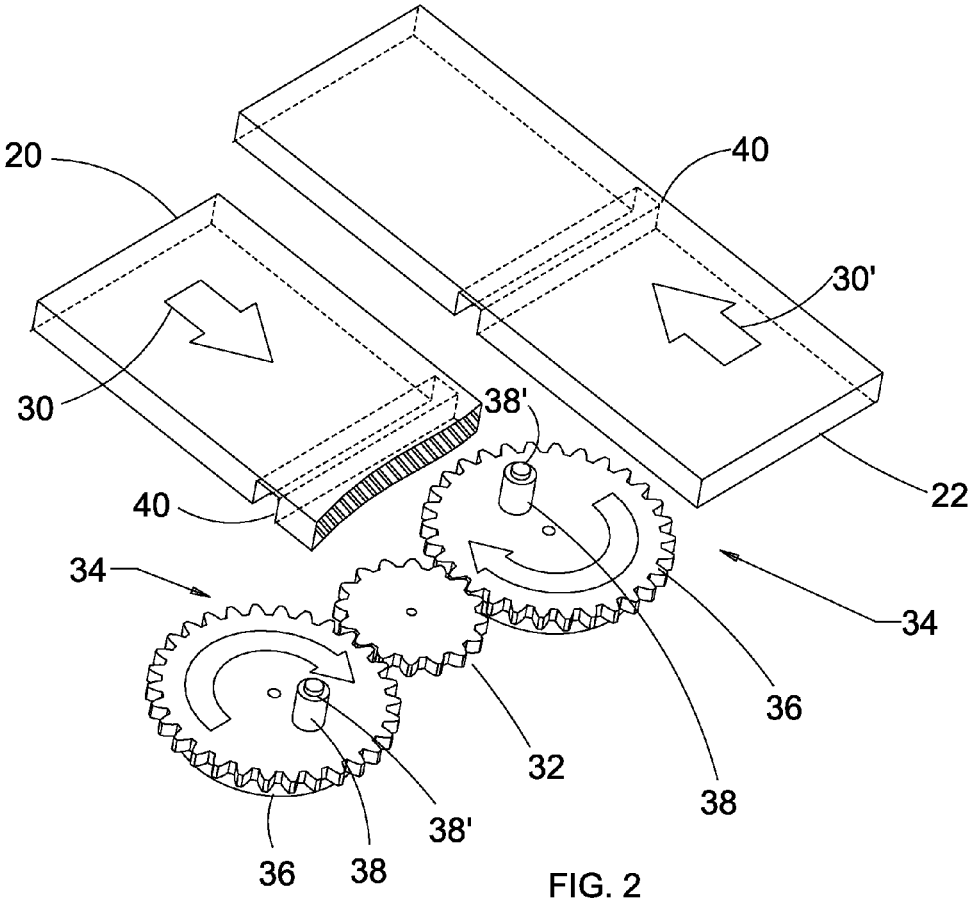
FIG. 2 is a schematic representation in partial cutaway and exploded form of one embodiment of a leg exercise assembly in accordance with the present disclosure.
Figure 3:
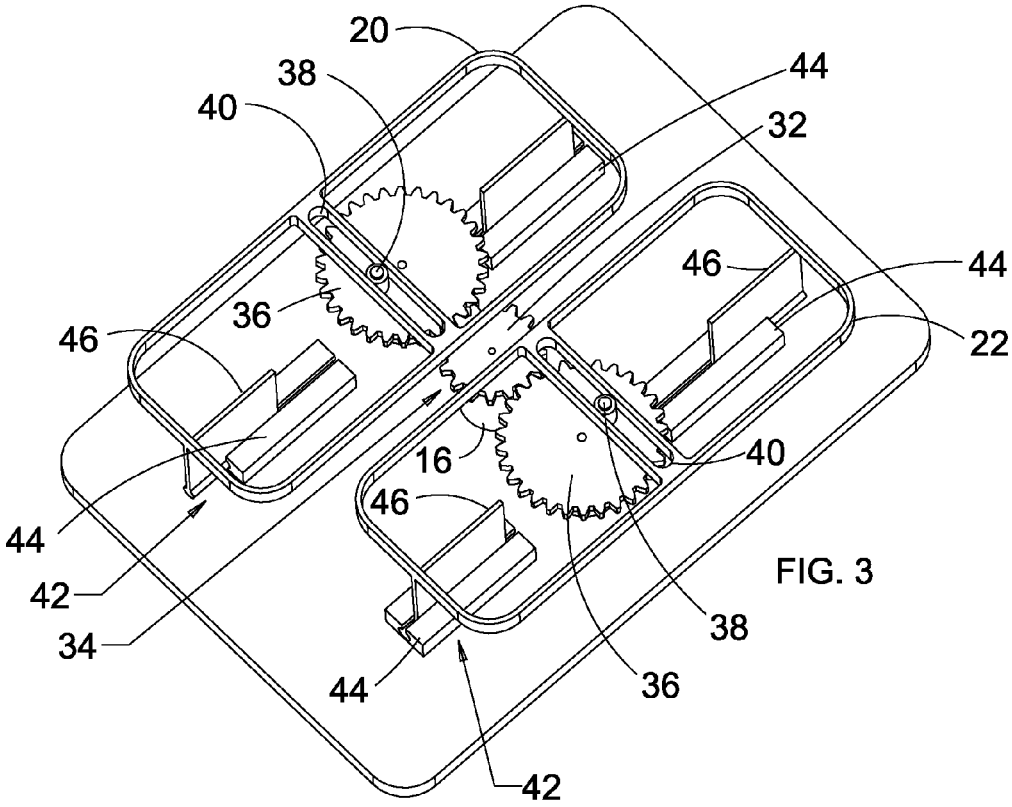
FIG. 3 is a perspective view in schematic form of another embodiment of a leg exercise assembly in accordance with the present disclosure.
Figure 3A:
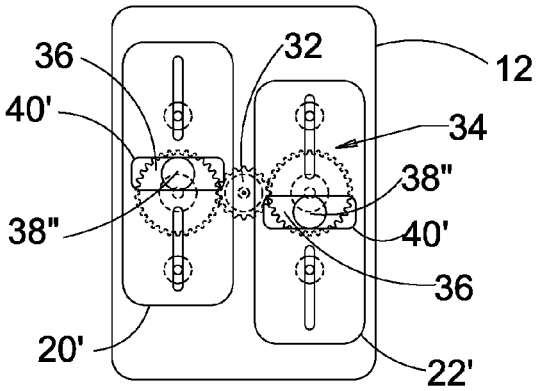
FIG. 3A is a structural modification of the embodiment of FIG. 3.

As also indicated, the structural and operative features of the various embodiments of the leg exercising assembly 10 provide for a prescribed forced movement or travel of the two support members 20 and 22. Therefore, with primary reference to FIG. 2, the intended linear, oppositely directed, reciprocating movement or travel of each of the support members 20 and 22, relative to one another is schematically represented by directional arrows 30 and 30'. To accomplish such movement of the support members 20 and 22, each of the various embodiments of the leg exercise assembly 10 include at least one drive member 32 and a drive linkage generally indicated as 34. In the embodiment of FIGS. 2, 3 and 3A, the at least one drive member 32 is in the form of a rotary gear and the drive linkage 34 comprises connecting linkage including two linking gears 36 connected in driven relation to the drive member 32. In addition, the drive linkage 34 also includes at least one, but in the embodiment of FIGS. 2, 3 and 3A, a plurality of cam members 38, 38" each connected in off-set (non-centered) relation to the center or axis of rotation of each of the linking gears 36.

The embodiments of FIGS. 2, 3 and 3A also include a connector structure formed on each of the support members 20 and 22. The connector structure comprises a plurality of two cam races 40, wherein each cam race 40 is connected to and movable with a different one of the support members 20 and 22. Structural differences between the embodiment of FIG. 2 and that of FIGS. 3 and 3A include the cam races 40 of FIG. 2 being integrally formed on the respective support members 20 and 22 by being at least partially defined by channels or grooves extending through the under portions of the corresponding support members 20 and 22. In contrast, the embodiment of FIGS. 3 and 3A comprises the connector structures including the two cam races 40 each including open slots or passages having a linear configuration and being dimensioned to allow passage of the corresponding cam members 38, 38" at least partially therethrough. In such an operative position, each of the cam members 38, 38" are movably disposed to slide within the respective cam races 40 in driving relation to the cam races 40 and the support members 20 and 22 associated therewith.

It is further noted that each of the cam members 38 may include a bearing structure 38', as shown in FIG. 2, which allows the cam members 38 to rotate about a rotational axis of the cam members 38. As a result, each of the cam members 38 may be structured to concurrently rotate about their corresponding rotational axis as the cam member 38 moves within and along the length of the corresponding cam race 40 in driving engagement therewith. It is of further note that each of the cam members 38 are oppositely disposed relative to one another in an offset relation to the center of the respective linking gears 36. Such an opposite, offset disposition of the cam members 38 facilitates the forced movement or travel of each of the support members 20 and 22 in a linear, oppositely directed, reciprocal manner relative to one another, such as upon activation of the drive motor 16. As should be apparent, the positioning and structuring of the drive member or drive member 32 forces the rotation of the connecting linkage in the form of the two linking gears 36 in opposite directions which, in accord with the oppositely offset disposition of the cam members 38, will cause the aforementioned reciprocal travel or motion of the support members 20 and 22.

Other structural and operative features associated with the embodiments of FIGS. 3 through 12A include the provision of a mounting assembly 42 comprising at least one but more practically a plurality of tracks or guides 44 slidably receiving supporting links 46 therein. As represented in FIG. 3, the supporting links 46 are secured to the under portion and/or any other appropriate portion of each of the two supporting members 20 and 22. Due to the sliding interaction between the links 46 and the tracks or guides 44, the aforementioned reciprocal motion of the support members 20 and 22 is further facilitated.

Additional structural modifications between the embodiments of 3 and 3A include a variance in the dimension of the cam members 38, 38" and corresponding cam races 40, 40'. This variance in dimension and/or configuration between the cam members 38, 38" and cam races 40, 40' may serve to accommodate greater or lesser weights intended to be supported by the corresponding support members 20, 20' and 22, 22'. However, the operative features of the drive member 32 and linking gears 36 are substantially equivalent in each of the structurally modified embodiments of FIGS. 3 and 3A.

Yet another embodiment of the leg exercise assembly 10 is represented in FIGS. 4, 4A, 5, 5A and 6, wherein the drive member 32 is not in the form of a drive gear but is disposed and structured to be rotationally driven by the drive motor (not shown for purposes of clarity). In addition, the drive linkage 34 comprises an elongated shaft 35 (see FIG. 4A) having a substantially centrally disposed race 40" fixedly connected to the shaft 35 and disposed in transverse or substantially perpendicular relation thereto. In addition, the drive linkage 34 includes at least one cam member 39 connected to or mounted on the drive member 32 so as to rotate therewith. The transverse orientation of the cam race 40" relative to the length of the shaft 35 and the offset disposition of the cam member 39, relative to the center of the drive member 32 results in a reciprocal, linear path of travel 35' of the shaft 35, within supports 51, as the drive member 32 rotates.

In cooperation therewith, each of the support members 20 and 22 include an individual cam race 40 having a linear configuration and disposed in receiving, driven relation by a corresponding cam member 38. Each of cam members 38 are connected to opposite ends or at least in spaced relation along the length of the transverse shaft 35. In addition, as clearly represented in FIGS. 4 through 6, each of the cam races 40 associated with the individual support members 20 and 22 are disposed at an angular orientation relative to the length or longitudinal axis of the respective support members 20 and 22. The cooperative disposition and orientation of the various components of the drive linkage 34, as set forth above, and that of the angularly oriented cam races 40, defining the connector structure of the support members 20 and 22, results in a reciprocal linear travel of each of the cam members 38 in their respective cam races 40 to and from ends 41, 41', as indicated by directional arrows 43. In turn, the rotation of the drive member 32 as well as the associated cam member 38 mounted thereon will result in the concurrent linear, reciprocal movement 35' of the rod or shaft 35 as well as the travel of the respective cam members 38 in their corresponding cam races 40. As a final result, each of the support members 20 and 22 will be forced into the aforementioned linear, oppositely directed, reciprocal motion indicated as 23.

Figure 5:
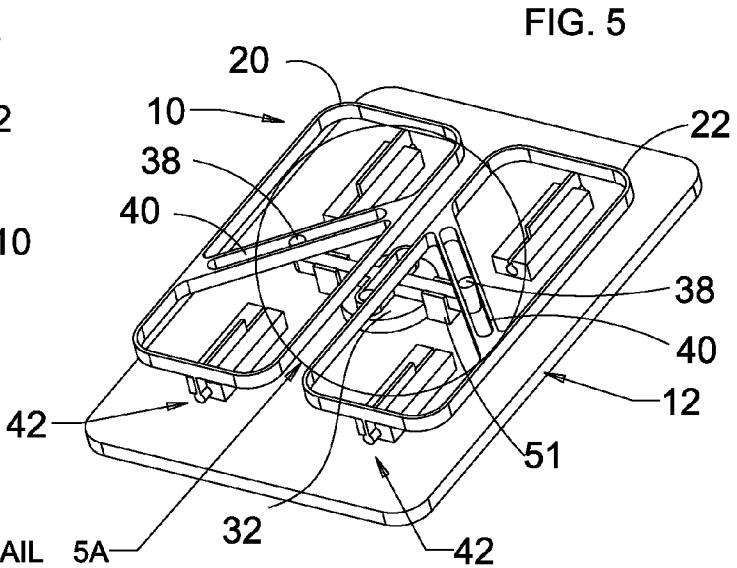
FIG. 5 is a different perspective view of the embodiment of FIG. 4.
Figure 5A:
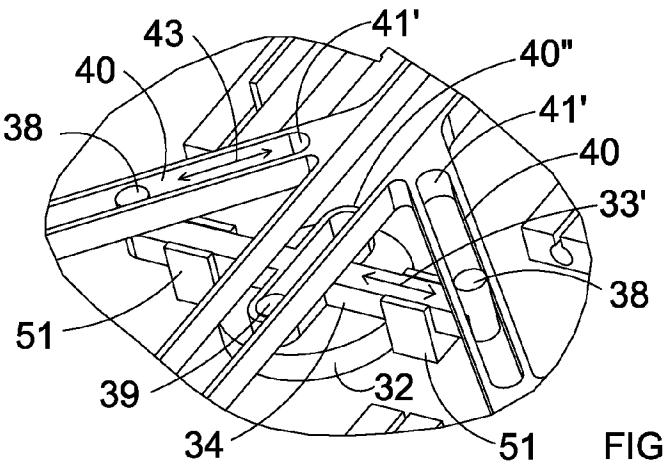
FIG. 5A is a detailed perspective view of the indicated portion of the embodiment of FIG. 5.
Figure 4:
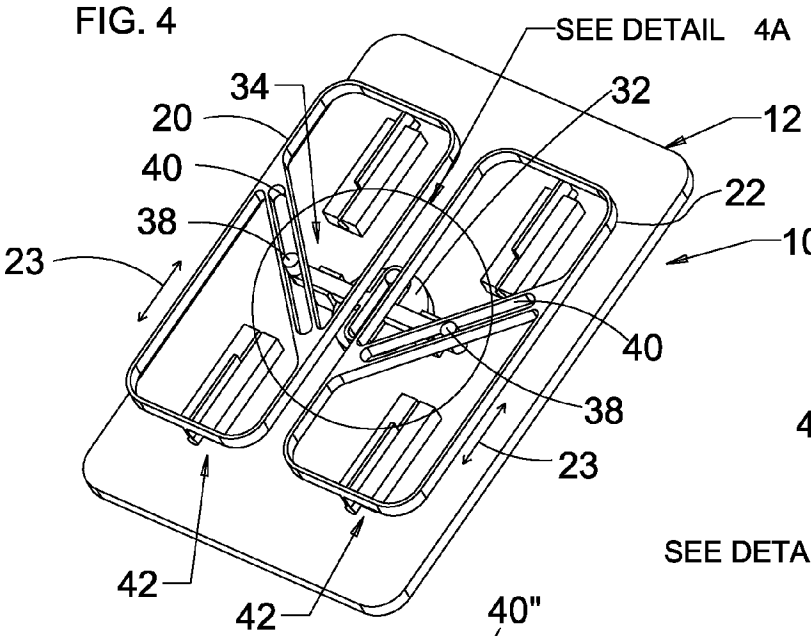
FIG. 4 is a perspective view in schematic form of one other embodiment of a leg exercise assembly in accordance with the present disclosure.
Figure 4A:
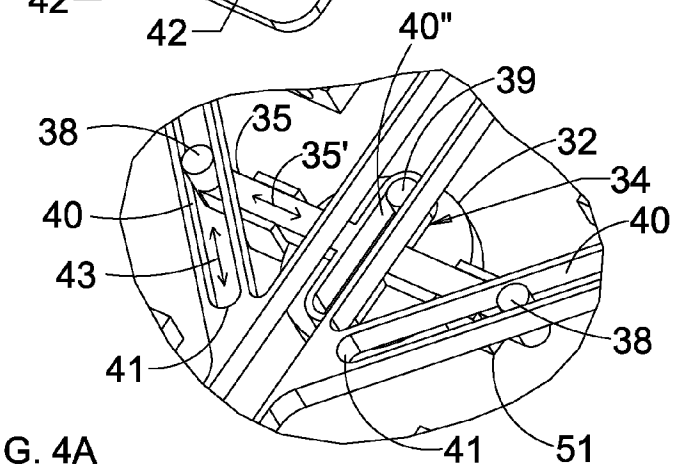
FIG. 4A is a detailed perspective view of the indicated portion of the embodiment of FIG. 4.
Figure 6:
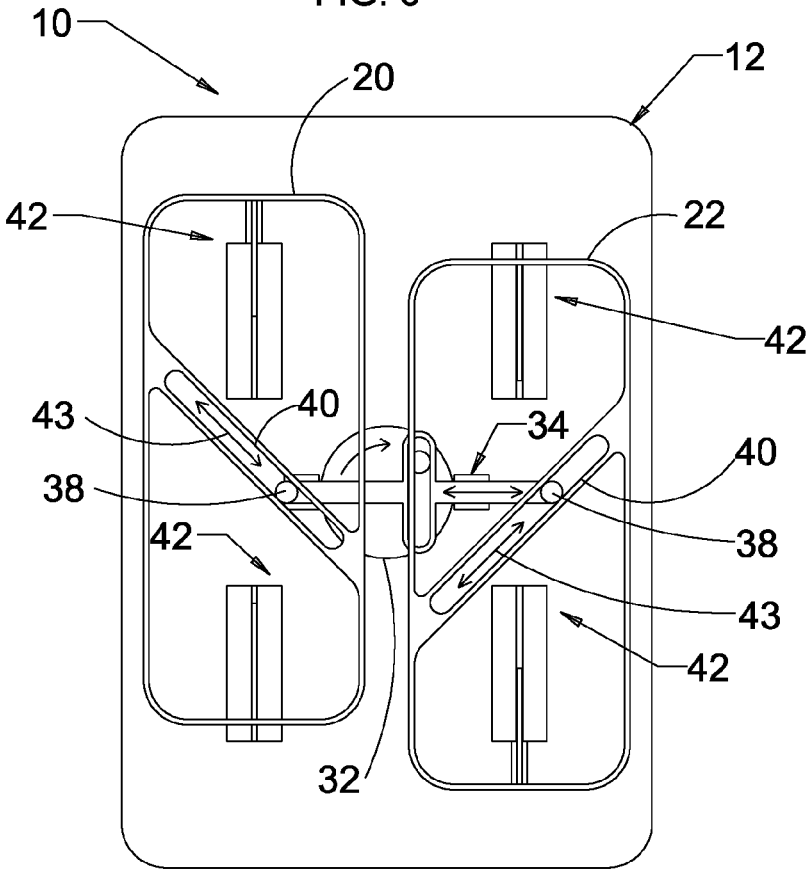
FIG. 6 is a top view in schematic form of the embodiment of FIG. 4, disposed in a different operative position.
Figure 8:
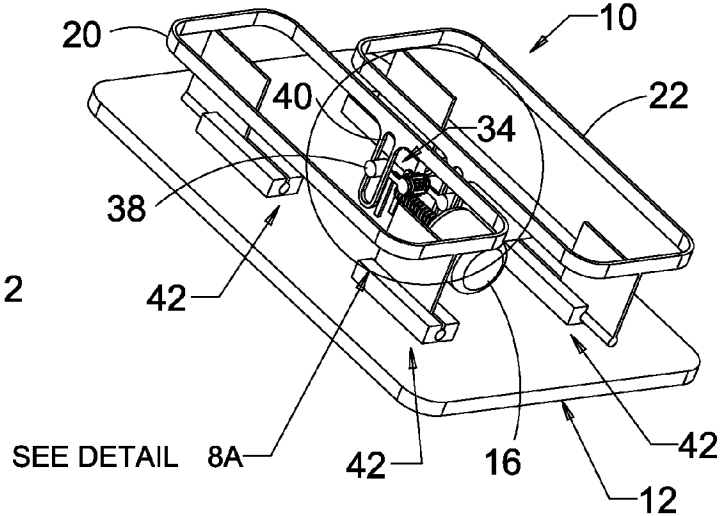
FIG. 8 is a perspective view of the embodiment of FIGS. 7 and 7A in a different operative position.
Figure 8A:
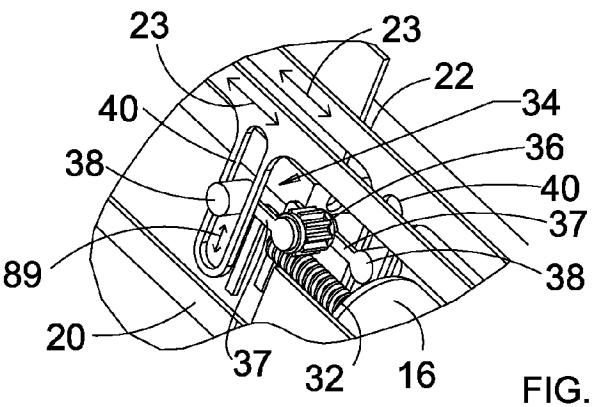
FIG. 8A is detailed perspective view of the indicated portion of the embodiment of FIG. 8.
Figure 7:
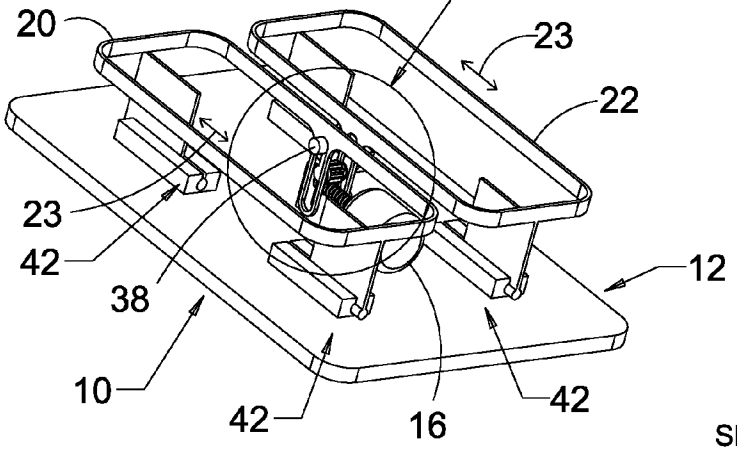
FIG. 7 is a perspective view in schematic form of yet another embodiment of a leg exercise assembly in accordance with the present disclosure.
Figure 7A:
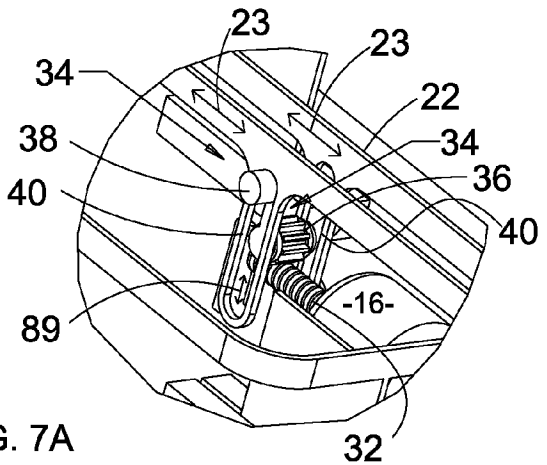
FIG. 7A is a detailed perspective view of the indicated portion of the embodiment of FIG. 7.

Further by way of example, FIG. 4A represents a detailed view of the embodiment of FIG. 4 wherein the respective cam members 38 are positioned in the center of each corresponding cam race 40, cam member 39 is disposed at the upper end of cam race 40", and support members 20 and 22 are disposed substantially side by side. Similarly, the detailed view of FIG. 5A is derived from FIG. 5, which is the perspective view of the embodiment of FIG. 4 rotated 180°, wherein the respective cam members 38 are again positioned in the center of each corresponding cam race 40, cam member 39 is disposed at the lower end of cam race 40", and once again, support members 20 and 22 are disposed substantially side by side. Turning next to FIG. 6, however, we see that as the drive member 32 is rotated to the right, cam member 38 is pulled downward in cam race 40 of support member 20 while cam member 38 is pushed upward along cam race 40 of support member 22. As a result, the continuous rotation of the drive member 32 will force the support members 20 and 22 into the aforementioned linear, oppositely directed, reciprocal motion 23 as the cam members 38 travel along their corresponding cam races 40.

Yet another embodiment of the leg exercise assembly 10 is represented in FIGS. 7, 7A, 8 and 8A and differs from the other embodiments of the leg exercise assembly 10 disclosed herein as a result of structurally modified but similarly operative components including, but not limited to, the drive member 32, drive linkage 34 and connector structure. Despite such variances in the structure of these components, the support members 20 and 22, are still forced to move in the aforementioned linear, oppositely directed reciprocal path of travel relative to one another. More specifically, the leg exercise assembly 10 as represented in FIGS. 7, 7A, 8 and 8A include the two support members 20 and 22 being driven by the drive motor 16. In addition, the at least one drive member 32 is in the form of an elongated worm gear rotationally driven by the drive motor 16. The drive linkage 34 comprises a drive gear 36 connected or disposed in driven relation by the drive member/worm gear 32. Further, the drive gear 36 of the drive linkage 34 includes two oppositely disposed cam members 38 connected to the drive gear 36 by elongated arms 37. As also represented, each of the oppositely disposed cam members 38 are received within and travel along the length of correspondingly disposed cam races 40. As such, each cam member 38 serves to drive the corresponding support members 20 and 22 through interaction of each cam member 38 with the corresponding cam race 40. It is of course noted that the cam race 40 associated with each of the support members 20 and 22 are located in a substantially vertical orientation and are thereby distinguishable from the horizontally transverse or angular orientations, as represented in the previously disclosed embodiments. Accordingly, activation of the drive motor 16 causes rotation of the drive member/worm gear 32, which is disposed in driven relation to the connecting linkage in the form of drive gear 36 of the drive linkage 34. The drive linkage 34 is also at least partially defined by the cam members 38 connected to the drive gear 36 by the outwardly extending, oppositely directed arms 37. The rotation of the drive gear 36 of the drive linkage 34 thereby causes a reciprocal travel of each of the cam members 38 along the length of their respective cam races 40, indicated by direction arrow 89, as the cam members 38 rotate with the drive gear 36. This interaction between the cam members 38 and their corresponding cam races 40 serves to force each of the support members 20 and 22 along the intended linear, oppositely directed, reciprocal path of travel as schematically represented as 23 in FIGS. 7 and 8.

Figure 10:
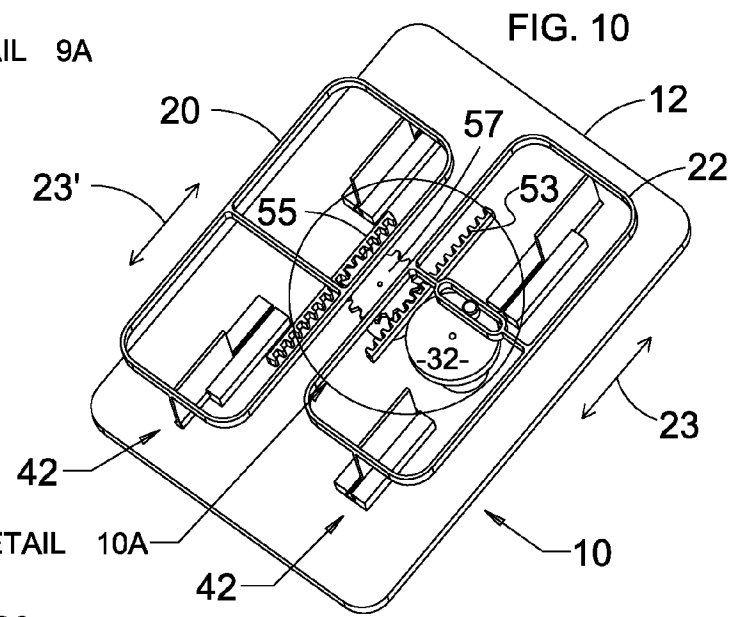
FIG. 10 is a perspective view in schematic form of the embodiment of FIGS. 9 and 9A in a different operative position.
Figure 10A:
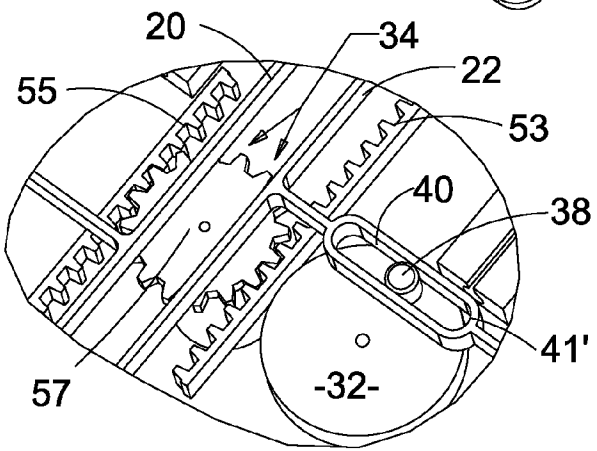
FIG. 10A is a detailed perspective view of the indicated portion of FIG. 10.
Figure 9:
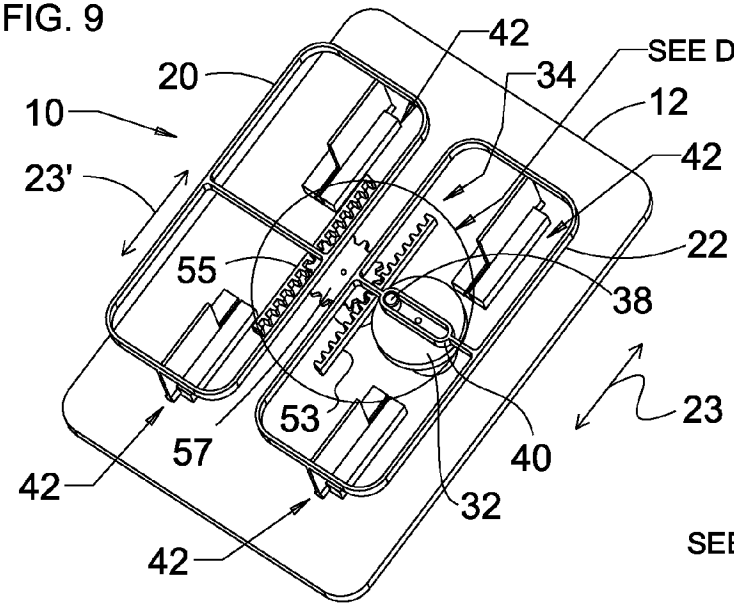
FIG. 9 is a perspective view in schematic form of a further embodiment of a leg exercise assembly in accordance with the present disclosure.
Figure 9A:
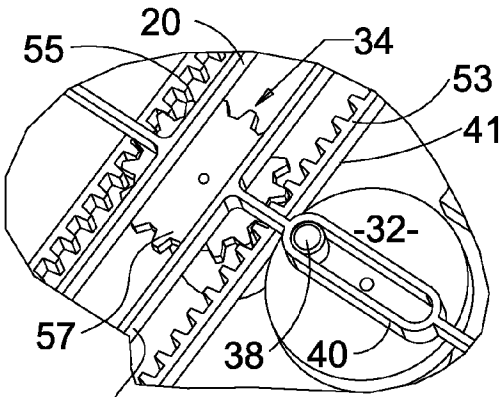
FIG. 9A is a detailed perspective view of the indicated portion of FIG. 9.

With primary reference to FIGS. 9, 9A, 10, and 10A, a further embodiment of the leg exercise assembly 10 includes yet additional structural modifications of the operative components including the drive member 32, the drive linkage 34 and the connector structure having at least one cam race 40. More specifically, the drive member 32 is rotationally driven by the drive motor 16 (not shown for purposes of clarity) and includes at least a portion of the drive linkage 34 mounted thereon. As represented, the drive linkage 34 includes a single cam member 38 mounted in off center relation to the drive member 32 and rotatable therewith. Further, the cam member 38 is received within the cam race 40 so as to move along the length thereof and be disposed in driving relation thereto. In cooperation therewith, the drive linkage 34 comprises connecting linkage in the form of a first rack gear 53 and a second rack gear 55 each fixedly connected to a different one of the support members 20 and 22 and movable therewith. In addition, connecting linkage of the drive linkage 34 includes an additional linking gear 57 disposed in interconnecting relation between the rack gears 53 and 55. Accordingly, upon forced rotation of the drive member 32 by the drive motor 16, the cam member 38 will be forced to travel reciprocally within the linearly configured cam race 40. As a result, the support member 22 will be forced to travel in the linear, reciprocal manner as indicated by directional arrow 23. As set forth above, due to the fact that the connecting linkage of the drive linkage 34 includes a plurality of linking gears including rack gear 53, intermediate gear 57 and rack gear 55, the reciprocal travel of the fixedly connected rack gear 53 will cause rotation of the intermediate gear 57 which in turn is disposed in driving engagement with the rack gear 55. As a result, the reciprocal travel of the support member 22, as schematically indicated at 23 will cause concurrent, linear, oppositely directed reciprocal movement of the support member 20, as indicated by directional arrow 23'. FIGS. 9, 9A and 10, 10A represent different operative positions of the drive member 32, cam member 38, cam race 40 and support members 20 and 22. As such, when the cam member 38 is at or near a one end 41 of the cam race 40, as illustrated in FIG. 9A, the support members 20 and 22 will be in substantially aligned relation to one another, but traveling in opposite directions, as schematically indicated by directional arrows 23 and 23' in FIG. 9. In contrast, the travel of the cam member 38 within the cam race 40 towards the opposite end 41', as shown in FIG. 10A, will result in offset disposition of the support members 20 and 22, as they reciprocally travel in opposite directions, as illustrated in FIG. 10.

The structural and operative versatility of the leg exercise assembly 10 of the present disclosure is further demonstrated in the embodiment of FIGS. 11, 11A, 12 and 12A. As schematically represented, a drive motor 16 is electrically powered, as set forth above, and reciprocally drives a shaft or link 60, at least partially defining the drive member 32, in a substantially linear direction relative to the central axis of the drive motor 16. In addition, due to the fact that the drive motor 16 is structured to operate in a linear, reciprocal manner, it is also pivotally connected to the base 12, as at 61. Therefore, upon activation of the drive motor 16, the reciprocally driven link 60 defining the drive member 32 moves both linearly and concurrently pivots relative to the base 12 about the pivotal axis 61 associated with the drive motor 16. In addition, the distal end of the link 60 includes a connector structure 63 and 63' attached to the support member 22. As a result, the forced, driven movement of the link 60 by activation of the drive motor 16 will cause the support member 22 to be forced into a linear, reciprocal motion as schematically indicated by directional arrow 23. As generally described with regard to the embodiments of FIGS. 9 and 10, the drive linkage 34 also includes connecting linkage in the form of a plurality of linking gears including rack gears 53 and 55 fixedly secured to and movable with the support member 22 and 20 respectively and intermediate gear 57, disposed in driven relation to the rack gear 53 and in driving relation to the rack gear 55. Similarly, the rack gear 55 is fixedly connected to and movable with the support member 20. Upon activation of the drive motor 16, the reciprocally driven link 60 of the drive member 32 will cause the linear, reciprocal movement 23 of the support member 22 due to its interconnection with the connector structure in the form of a structures 63 and 63'. Such linear movement 23 of the support member 22 will serve to drive intermediate gear 57 and in turn drive the rack gear 55. Due to the fact that the rack gear 55 is fixedly secured to the support member 20, the support member 20 will be forced into a linear, oppositely directed, reciprocal path of travel as schematically indicated by directional arrow 23', relative to the support member 22.

Figures 11, 11A, 12, 12A:
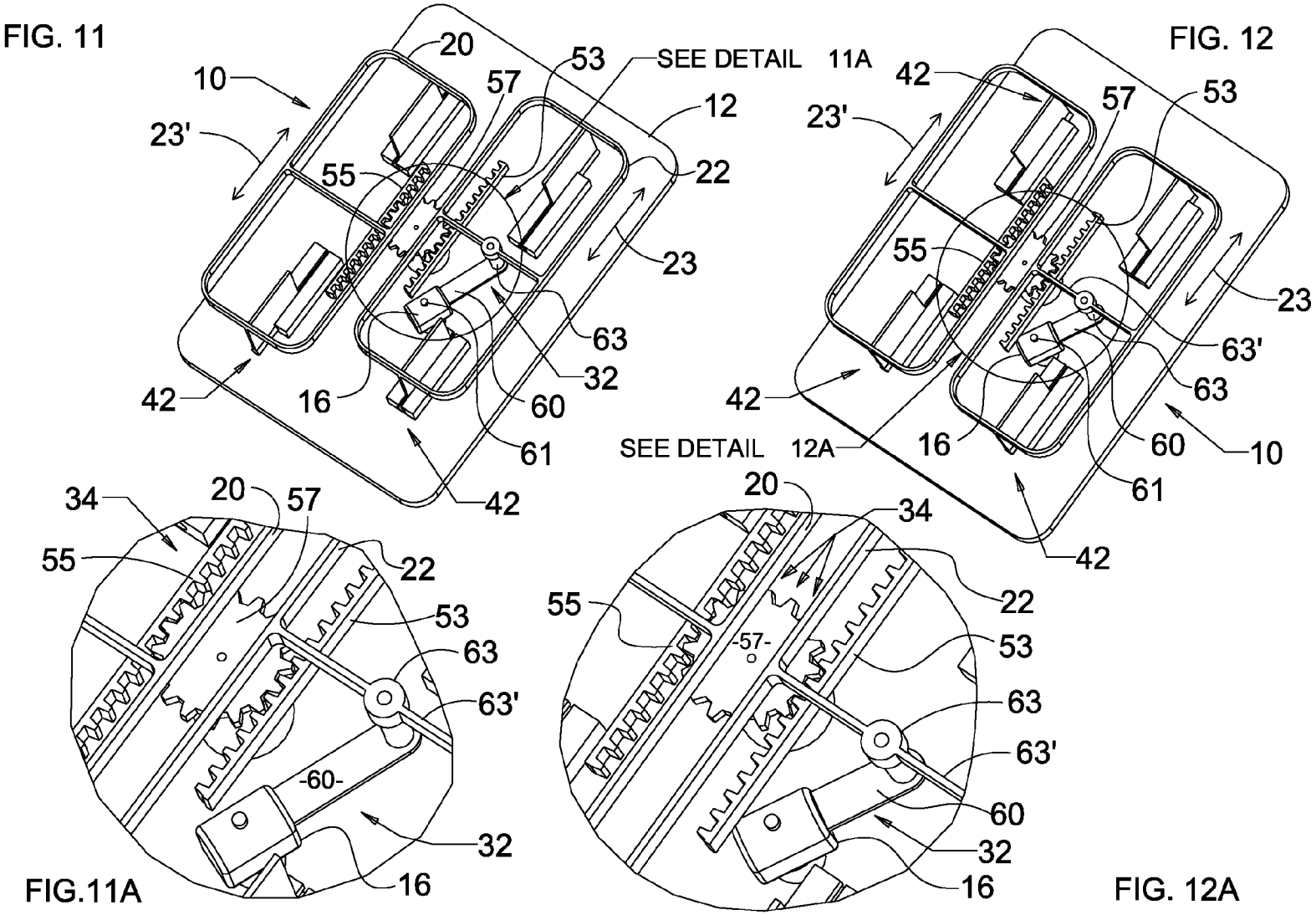
FIG. 11 is a perspective view in schematic form of another further embodiment of a leg exercise assembly in accordance with the present disclosure.
FIG. 11A is a detailed perspective view of the indicated portion of the embodiment of FIG. 11.
FIG. 12 is a perspective view in schematic form of the embodiment of FIGS. 11 and 11A in a different operative position.
FIG. 12A is a detailed perspective view of the indicated portion of the embodiment of FIG. 12.

The detailed FIGS. 11A and 12A are representative of the different positions of the support members 20 and 22 upon activation of the drive motor 16 and the pivotal/linear forced movement of the link 60 and connector structure 63 and 63'.

Since many modifications, variations and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An assembly structured to facilitate exercise of the legs of a user while in an at least partially seated orientation, said assembly comprising:

a base and a drive motor mounted on said base, at least two support members each disposed and structured to movably and at least partially support a different foot of the user, at least one drive member connected in driven relation to said drive motor, a drive linkage including a cam assembly disposed in driven relation to said drive motor and structured to move along a predetermined path of travel, a connector structure including at least two cam races each disposed on and movable with a different one of said two support members in receiving, driven relation to said cam assembly, said cam assembly comprising at least two cam members each disposed in driving relation with a different one of said two cam races, and said drive linkage and said connector structure cooperatively disposed and structured to establish linear, oppositely directed, reciprocal travel of said two support members relative to one another upon actuation of said drive motor.

2. An assembly as recited in claim 1 wherein said predetermined path of travel of said cam assembly is rotational.

* * * * *